United States Patent [19]

Borda et al.

[11] 4,343,044

[45] Aug. 10, 1982

[54] STRETCHABLE SPEED SWIM SUIT

[75] Inventors: William F. Borda, Laureldale; Thomas M. Fry, Greenfields; Charles A. Rist, Jr., Muhlenberg Park, all of Pa.

[73] Assignee: Dolfin Corporation, Shillington, Pa.

[21] Appl. No.: 176,621

[22] Filed: Aug. 11, 1980

Related U.S. Application Data

[63] Continuation-in-part of Ser. No. 1,925, Jan. 8, 1979, abandoned, which is a continuation-in-part of Ser. No. 845,338, Oct. 25, 1977, abandoned.

[51] Int. Cl.[3] ..... A41D 5/00

[52] U.S. Cl. ..... 2/67

[58] Field of Search ..... 2/67, 78 R, 406; 66/202

[56] References Cited

U.S. PATENT DOCUMENTS 3,255,754 6/1966 Brumberger ..... 2/67

3,436,762 4/1969 Cahan ..... 2/67

*Primary Examiner*—Doris L. Troutman

*Attorney, Agent, or Firm*—Caesar, Rivise, Bernstein & Cohen, Ltd.

[57] ABSTRACT

A swim suit designed for competitive racing is made of knit mesh fabric of hydrophobic synthetic stretch yarn knitted in a small atlas type of pattern having a multitude of openings therein. The yarn is within the range of 40% to 100% denier so that the openings comprises in the range of 40% to 60% of the fabric, whereupon the entire suit has flow-through characteristics, that is, water and air pass freely through the openings in the mesh, thereby avoiding entrapment of water and/or air, with resultant avoidance of billowing and bubbling while being sufficiently opaque to conceal the underlying body of the wearer. Both men's and women's suits are provided and each includes a liner portion formed of the same fabric as the swim suit.

17 Claims, 3 Drawing Figures

STRETCHABLE SPEED SWIM SUIT

This application is a continuation-in-part of application Ser. No. 1,925 filed on Jan. 8, 1979 now abandoned and which in turn is a continuation-in-part of application Ser. No. 845,338, filed on Oct. 25, 1977, now abandoned, the disclosures of both applications being incorporated by reference herein.

This invention relates generally to swim wear and more particularly to swim suits for competitive racing.

It has long been desired to provide competitive swim suits which would contribute to faster swimming speeds. To that end, the prior art has provided various cuts and contours for the suits to provide acceptable body coverage yet be sufficiently light in weight and not susceptible to bubbling, billowing and drag. In this regard, the prior art has recognized that natural fibers such as wool and cotton are readily wet. Since these fibers absorb water, the weight of the suit increases considerably when the swimmer enters the water. This action causes an increase in drag and reduces the speed at which the swimmer is able to swim.

The prior art has sought to solve the drag problem by the use of swim suits fabricated of synthetic fibers such as nylon and dacron, which have hydrophobic properties to resist wetting. While such fibers do not absorb water, they nevertheless entrap water and air within the tiny holes of the fabric. Such action results in the creation of substantial drag through the water.

In U.S. Pat. No. 3,436,762 (Cahan), a swim suit is disclosed which is ostensibly constructed to minimize the drag effect caused by the entrapment of water within the swim suit. To that end, the Cahan patent discloses a woman's swim suit made entirely of a two-way stretch fabric, described as nylon tricot containing 40% elastic yarn sold under the trademark "Lycra". A stretch nylon mesh fabric panel is located at the front of the suit below the bust area to function as a water discharge window. The panel is formed of nylon, two-way stretch mesh fabric material, such as Lycra power net. The porosity of the Lycra power net is stated to be such that it provides zero impedance to water flowing through the panel at a velocity of at least 7 miles per hour.

The bust area of the swim suit in the Cahan patent is formed of a non-mesh nylon tricot and does not pass water therethrough. Accordingly, water which enters at the neck and chest area of the Cahan swim suit is required to travel inside the suit for a distance of approximately 4½ inches to exit through the front discharge window panel.

There is no provision for discharge, through the fabric of the suit, of water which enters at the top of the suit, at the back, and under the arms, and travels down between the skin of the swimmer and the back and side panel of the suit. Thus, at least some of the water which enters the suit is trapped therein, which will necessarily cause billowing of the suit and increased drag through the water. Moreover, the necessity of attaining a velocity of 7 miles per hour to achieve the stated zero impedance is severely restrictive.

In our co-pending U.S. Patent application Ser. No. 1,925, filed on Jan. 8, 1979, there is disclosed and claimed a swim suit for competitive racing which overcomes the disadvantages of prior art swim suits and allows for increased speed. To that end, that invention entails swim suits made for either men or women entirely of a knit mesh fabric which readily allows water and air to pass through the fabric to minimize drag, yet exhibits sufficient opacity to provide adequate concealment of the underlying body portions of the wearer and is attractive in appearance and comfortable to wear. The suits are fabricated of a knit mesh tricot fabric, made up of continuous filament, non-stretch, synthetic fibers having hydrophobic properties, e.g., nylon and/or dacron. The fabric is knitted so that it has a multitude of holes or openings of sufficient size to allow water and air to pass therethrough without entrapment while being sufficiently small to provide adequate opacity so that when the swim suit is worn, the underlying portions of the wearer's body are concealed. In a preferred embodiment of the invention disclosed in said patent applications, the fabric is tricot having diagonal ribs formed of 70-denier nylon with the mesh having on the order of 200–300 openings per square inch so that the open area per square inch of fabric is on the order of 40–60%.

Moreover, in the preferred embodiments of that invention, a mesh liner, constructed similarly to the fabric of the swim suit, is provided on the underside of the mesh of the swim suit in the bust and crotch regions of the women's swim suit and in the crotch region of the men's swim suit to provide additional opacity and concomitant body concealment.

The swim suits constructed in accordance with the invention disclosed and claimed in our aforementioned patent applications have proved an unqualified success from the functional standpoint, and the swim suits of the instant invention retain these functional characteristics and are even more desirable from an appearance standpoint. In this regard, when swim suits constructed in accordance with the teachings of our aforenoted patent applications are worn so that the multitude of openings are against the body with no light passing through, the suits are sufficiently opaque to avoid any justifiable criticism that the suits are immodest or risque, yet when such suits are hanging free, such as when they are hung on a rack or held up in the ambient light, the multitude of openings in the fabric gives the fabric the appearance of a "see-through" mesh. This characteristic may act as a deterrent to purchase of the swim suit by persons who assume that the "see-through" appearance of the suit in its free state will also exist when the suit is worn.

Accordingly, it is the general object of the instant invention to overcome the disadvantages of the prior art and to provide swim suits which are an improvement of the swim suits of our aforenoted patent applications.

It is a further object of this invention to provide swim suits which are formed of a fabric allowing water and air to pass freely therethrough, yet which exhibit substantial opacity irrespective of whether the suit is worn or not.

It is a further object of the instant invention to provide speed swim suits which closely conforms to the body of the wearer.

These and other objects of the instant invention are achieved by providing a speed swimming suit fashioned out of hydrophobic, synthetic stretch yarn which is knit into an open mesh fabric having a multitude of openings therein of sufficient size to allow water and air to pass freely therethrough to avoid water retention, water entrapment and resultant billowing of said fabric, while being sufficiently opaque to conceal the underlying body of the wearer. The mesh comprises a plurality of courses and wales formed of loops in lengths of said yarn. The yarn lengths are disposed in a first group and a second group. Each yarn length of the first group forms a loop in each consecutive course, with the loops of the first group of yarn lengths being disposed consecutively in at least three alternate courses extending in a first direction and at least three alternate courses extending in a second, opposite, direction. Each yarn length of the second group forms a loop in each consecutive course, with the loops of the second group of yarn lengths being disposed consecutively in at least three alternate courses extending in said second direction and at least three alternate courses extending in said first direction.

Other objects and many of the attendant advantages of the instant invention will be readily appreciated as the same becomes better understood by reference to the following detailed description when considered in connection with the accompanying drawing wherein.

Figure 1:
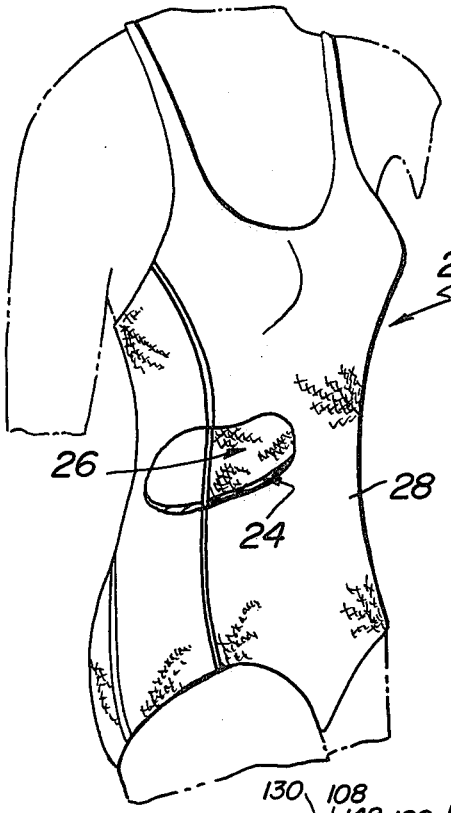
FIG. 1 is a perspective view of a woman's speed swim suit constructed in accordance with the instant invention.
Figure 2:
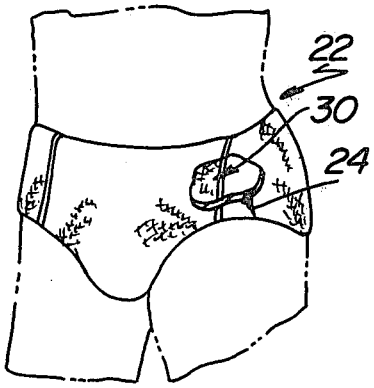
FIG. 2 is a perspective view of a man's speed swim suit constructed in accordance with the instant invention.

Referring now in greater detail to the various figures of the drawing wherein like reference characters refer to like parts, there is shown in FIGS. 1 and 2 a woman's speed swim suit 20 and a men's speed swim suit 22, respectively, each constructed in accordance with the instant invention. The only differences between the swim suits 20 and 22 is in their design, i.e., the shape or contour. Moreover, the designs are similar to those of prior art swim speed suits.

Inasmuch as the swim suits 20 and 22 are of identical construction, albeit different design, only the details of the woman's speed swim suit 20 will be described in detail hereinafter. To that end, as can be seen, the speed swim suit 20 basically comprises a body portion in the form of an outer shell 24 and a liner portion 26 in the front 28 of the shell and extending from the bust to the crotch area. A similar liner is in the rear of the swim suit 20. In the men's speed swim suit 22, the liner 30 is located in the crotch and rear areas. The shell and the liner portion of each swim suit is fashioned of the same knit fabric. The liner serves to provide additional opacity without significantly affecting performance of the suit in allowing water and air bubbles to freely pass therethrough.

The knit fabric from which the speed swim suits of this invention are fashioned will be described in detail later. Suffice for now to state that the fabric is a stretchable mesh which has been knitted to have a multitude of openings which, when the suit is worn and the fabric is stretched under tension, are sufficiently large to avoid, or at least substantially reduce water and air entrapment, yet small enough to render the fabric sufficiently opaque to adequately conceal the underlying body portions of the wearer. In addition, when the swim suit is in its free or unstretched state, such as when it is not being worn, the fabric contracts so that the openings in the mesh are reduced in size. This feature eliminates the tendency of the fabric to appear as a "see-through" material when held up to the light.

The fabric of the instant invention is knitted from a synthetic yarn of a continuous filament hydrophobic material, such as nylon, dacron, etc., or in combinations thereof. The yarn is preferably in the range of 40 to 100 denier, with 70 denier being optimum, and has been texturized in the interest of stretchability. The resulting stretchable mesh fabric has approximately 40% to 60% open area and approximately 200 to 300 openings per square inch when the swim suit is worn. When the suit is in its free or unstretched state, the fabric exhibits a smaller percentage of open area.

The yarn is preferably jet dyed to maintain its stretchability. Moreover, in the interest of water repellency, swim suits constructed in accordance with this invention are framed by finishing with a waterproofing or repellent material, such as sold under the trademark ZEPEL by E. I. Dupont de Nemours of Wilmington, Delaware.

Figure 3:
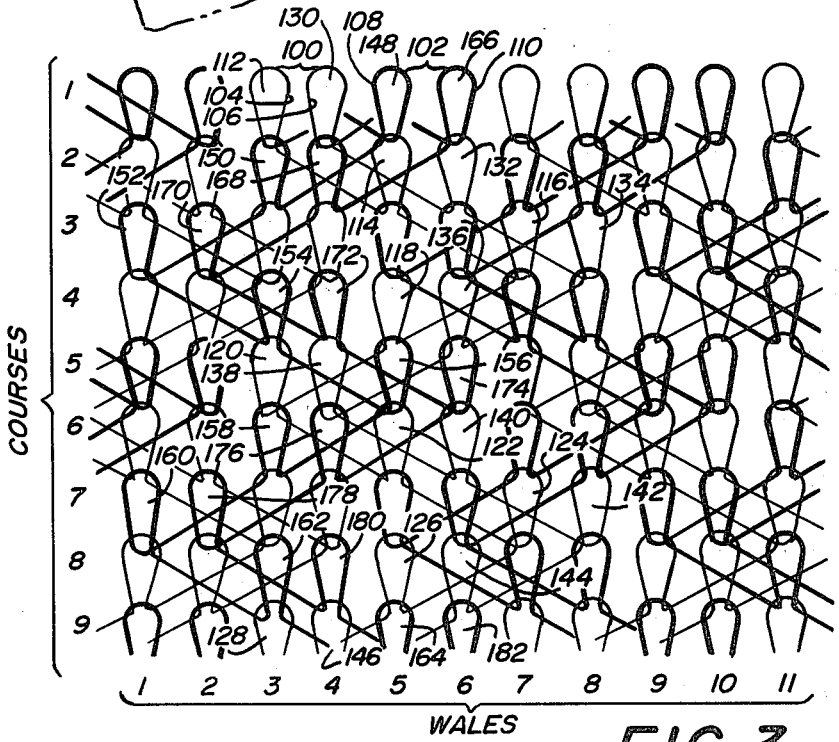
FIG. 3 is a schematic loop diagram showing a greatly enlarged portion of the fabric making up the swim suits shown in FIGS. 1 and 2.

In FIG. 3 there is shown in the form of a loop diagram, a greatly enlarged portion of the mesh fabric forming the shell and lining of the instant invention.

As will be appreciated by those skilled in the art, the loop pattern is that of a conventional "small atlas" type pattern which has been used heretofore, such as in undergarments, hosiery, etc. The fabric includes a front formed of plural pairs of yarn lengths and the rear formed of plural pairs of yarn lengths. The pairs of the front and rear are interlaced, with the pairs of the front being knitted in a general zig-zag pattern extending in one direction and with the pairs of the back being knitted in the same pattern, but extending in the opposite direction. This knitting technique is commonly referred to as "two in and two out".

As can be seen in FIG. 3, the pairs of yarn lengths are identified by the reference numerals 100 and 102. The pair or group 100 is composed of two yarn lengths 104 and 106, while the group 102 is composed of yarn lengths 108 and 110. It must be pointed out at this juncture that while the instant specification speaks in terms of yarn "lengths", it is to be understood that the multitude of yarn lengths shown and described can be of separate (individual) lengths of yarn or portions of a single or common length of yarn or a combination of separate and common lengths of yarn, as is desired.

The pairs 100 and 102 alternate throughout the entire width of the fabric.

Each yarn length of a pair includes a series of consecutive loops, respective ones of which are disposed in consecutive courses of the fabric but in alternate wales. To that end, the yarn length 104 includes consecutive loops 112, 114, 116, 118, 120, 122, 124, 126 and 128, which are located as follows: loop 112 is in course 1 wale 3, loop 114 is in course 2 wale 5, loop 116 is in course 3 wale 7, loop 118 is in course 4 wale 5, loop 120 is in course 5 wale 3, loop 122 is in course 6 wale 5, loop 124 is in course 7 wale 7, loop 126 is in course 8 wale 5 and loop 128 is in course 9 wale 3. Yarn lengths 106 are identical to yarn lengths 104 and include consecutive loops 130, 132, 134, 136, 138, 140, 142, 144 and 146. The loops of length 106 are located as follows: loop 130 is in course 1 wale 4, loop 132 is in course 2 wale 6, loop 134 is in course 3 wale 8, loop 136 is in course 4 wale 6, loop 138 is in course 5 wale 4, loop 140 is in course 6 wale 6, loop 142 is in course 7 wale 8, loop 144 is in course 8 wale 6 and loop 146 is in course 9 wale 4.

Thus, it can be seen that for each yarn length in pair of groups 100, e.g., yarn length 102, the consecutive loops, e.g., 112, 114, 116, 118 and 120, are located in respective consecutive courses, i.e., 1, 2, 3, 4 and 5, while they are located in three alternate courses extending in one direction, i.e., 3, 5 and 7, and three alternate courses extending in the opposite direction, i.e., 7, 5 and 3.

The yarn lengths 108 and 110 of group or pair 102 are disposed in a similar arrangement but in the opposite direction as the yarn lengths of group 100. To that end, the consecutive loops 148, 150, 152, 154, 156, 158, 160, 162 and 164 of length 108 are located in course 1 wale 5, course 2 wale 3, course 3 wale 1, course 4 wale 3, course 5 wale 5, course 6 wale 3, course 7 wale 1, course 8 wale 3, and course 9 wale 5, respectively. Similarly, the consecutive loops 166, 168, 170, 172, 174, 176, 178, and 180 of length 110 are located in course 1 wale 6, course 2 wale 4, course 3 wale 2, course 4 wale 4, course 5 wale 6, course 6 wale 4, course 7 wale 2, course 8 wale 4, and course 9 wale 6, respectively.

A practical embodiment of the fabric for forming the swim suits of this invention can be knitted on a 28 gauge tricot machine using a bottom bar needle arrangement of 10234532 and a top bar needle arrangement of 45321023.

While the swim suits disclosed herein are shown including the liner portions 26 and 30 to provide additional opacity in the crotch, bust and rear areas of the woman's swim suit and in the crotch and rear areas of the men's swim suit, the use of such linings is not mandatory and may be eliminated.

As will be appreciated from the foregoing, the swim suits of the instant invention provide a substantial improvement over prior art speed swim suits by permitting water and air to flow readily through the openings in the fabric. Such action prevents entrapment of water and air which would have the tendency to result in bubbling, billowing of the suit, and thus increase its drag through the water. The elimination of drag producing effects by the instant invention is accomplished without resulting in a swim suit which would be immodest or risque when worn, and without exhibiting a "see-through" appearance when free (not worn).

Without further elaboration, the foregoing will so fully illustrate our invention that others may, by applying current or future knowledge, readily adapt the same for use under various conditions of service.

What is claimed as the invention is:

1. A speed swim suit fashioned out of hydrophobic, synthetic stretch yarn knit into an open mesh fabric, said fabric having a multitude of openings therein of sufficient size to allow water and air to pass freely therethrough to avoid water retention, water entrapment and resultant billowing of said fabric, while being sufficiently opaque to conceal the underlying body of the wearer, said mesh comprising a plurality of courses and wales formed of loops in length of said yarn, said yarn lengths being disposed in a first group and a second group, each yarn length of said first group forming a loop in each consecutive course, the loops of the first group of yarn lengths being disposed consecutively in at least three alternate courses extending in a first direction and at least three alternate courses extending in a second, opposite, direction, each yarn length of said second group forming a loop in each consecutive course, with the loops of the second group of yarn lengths being disposed consecutively in at least three alternate courses extending in said second direction and at least three alternate courses extending in said first direction.

2. The swim suit of claim 1 wherein said openings comprise in the range of 40% to 60% of said mesh fabric.

3. The swim suit of claim 2 wherein said openings comprise approximately 50% of said mesh fabric.

4. The swim suit of claim 2 wherein said yarn is texturized.

5. The swim suit of claim 4 wherein said yarn is within the range of 40 to 100 denier.

6. The swim suit of claim 5 wherein said yarn is 70 denier.

7. The swim suit of claim 3 wherein said yarn is nylon.

8. The swim suit of claim 7 wherein said yarn is jet dyed.

9. The swim suit of claim 8 wherein said yarn is framed with a waterproofing finish.

10. The swim suit of claim 9 additionally comprising a lining formed of a second ply of mesh fabric of similar construction to that which the swim suit is fashioned.

11. A speed swim suit fashioned out of a continuous filament hydrophobic, stretchable synthetic yarn knit into an open mesh fabric having openings of sufficient size to allow water and air to pass freely therethrough to avoid water retention, water entrapment and resulting billowing of the mesh, said openings comprising in the order of 40% to 60% of the total area of the fabric when said suit is worn.

12. The swim suit of claim 11 wherein said openings comprise in the range of 40% to 60% of said mesh fabric.

13. The swim suit of claim 12 wherein said yarn is in the range of 40 to 100 denier.

14. The swim suit of claim 13 wherein said yarn is 70 denier.

15. The swim suit of claim 14 wherein said yarn is texturized.

16. The swim suit of claim 15 wherein said yarn is jet dyed.

17. The swim suit of claim 16 wherein said swim suit is framed with a waterproofing finish.

* * * * *